US005407767A

United States Patent [19]

Nogami et al.

[11] Patent Number: 5,407,767

[45] Date of Patent: Apr. 18, 1995

[54] PHOTOCONDUCTORS FOR ELECTROPHOTOGRAPHY WITH INDOLE AND BENZIDINE COMPOUNDS

[75] Inventors: Sumitaka Nogami; Yoichi Nakamura; Nobuyoshi Mori, all of Kawasaki, Japan

[73] Assignee: Fuji Electric Co., Ltd., Kanagawa, Japan

[21] Appl. No.: 192,729

[22] Filed: Feb. 7, 1994

[30] Foreign Application Priority Data

Feb. 12, 1993 [JP] Japan ..... 5-023086

[51] Int. Cl.[6] ..... G03G 5.047; G03G 5.09

[52] U.S. Cl. ..... 430/59; 430/83

[58] Field of Search ..... 430/59, 83

[56] References Cited

U.S. PATENT DOCUMENTS

| | | | |
|---|---|---|---|
| 3,314,788 | 4/1967 | Mattor . | |
| 3,484,237 | 12/1969 | Shattuck et al. . | |
| 4,727,009 | 2/1988 | Takai | 430/59 X |
| 4,988,595 | 1/1991 | Pai et al. | 430/59 |
| 4,999,268 | 3/1991 | Ojima et al. | 430/59 |
| 5,059,503 | 10/1991 | Muto et al. | 430/83 |

FOREIGN PATENT DOCUMENTS

| | | |
|---|---|---|
| 47-10785 | 5/1972 | Japan . |
| 47-37543 | 12/1972 | Japan . |

*Primary Examiner*—Roland Martin
*Attorney, Agent, or Firm*—Spencer, Frank & Schneider

[57] ABSTRACT

A photoconductor for electrophotography comprises an electroconductive substrate and a photosensitive layer formed on the conductive substrate and including a charge generating material and a charge transporting material. The charge transporting material comprises at least one compound selected from indole compounds represented by the following general formula (I) and at least one compound selected from benzidine compounds represented by the following general formula (II).

(I)

(II)

9 Claims, 1 Drawing Sheet

PHOTOCONDUCTORS FOR ELECTROPHOTOGRAPHY WITH INDOLE AND BENZIDINE COMPOUNDS

BACKGROUND OF THE INVENTION

1. Field of the Invention

The present invention relates to photoconductors for electrophotography, and particularly to a photoconductor for electrophotography which is made of an organic photoconductive material, and has excellent stability of characteristics in continuous repeated use.

2. Description of the Prior Art

Photoconductors for electrophotography (hereinafter to be referred to as a photoconductor) which have heretofore been used in a wide area is inorganic photoconductors in which use is made of inorganic photoconductive substances such as selenium, selenium alloys, zinc oxide and cadmium sulfide. On the other hand organic photoconductors in which use is made of organic photoconductive substances have been developed and been put into practical use by virtue of the advantageous features such as flexibility, thermal stability, and/or a film forming capacity. They include a photoconductor comprising poly-N-vinylcarbazole and 2,4,7-trinitrofluoren-9-on (disclosed in U. S. Pat. No. 3,484,237), a photoconductor using an organic pigment as a main component (disclosed in Japanese Patent Application Laying-Open No. 47-37,543), a photoconductor using as a main component a eutectic complex composed of a dye and a resin (disclosed in Japanese Patent Application Laying-Open No. 47-10,785). Although organic materials which have a number of advantageous features mentioned above, however they have not been used in a wide area by virtue of the features which are less advantageous than inorganic materials in photosensitivity, stability of characteristics in continuous repeated use and durability. In recent years, organic photoconductor having excellent property of being charged and photosensitivity have been developed and spread rapidly.

It is required that photoconductors usually have stability of conductive characteristic in continuous repeated use at an image formation process in the electrophotographic method. However, the fact is that there have been obtained no organic photoconductors fully satisfying the stability of characteristic required on the market at the present. As organic photoconductors are used repeatedly, there are problems that they are getting to be unsuitable for use by virtue of the disadvantageous features such as decreasing the electric potential, increasing the residual electric potential, changing in the photosensitivity and debasing the quality of the image formed.

SUMMARY OF THE INVENTION

An object of the present invention is to provide a photoconductor for electrophotography which is made of an organic photoconductive material, and has excellent stability of photoconductive characteristics, especially stability of the electric potential in continuous repeated use.

In the first aspect of the present invention, a photoconductor for electrophotography comprises:

a conductive substrate; and a photosensitive layer formed on the conductive substrate and including a charge generating material and a charge transporting material:

wherein the the charge transporting material comprises at least one compound selected from indole compounds represented by following general formula (I) and at least one compound selected from benzidine compounds represented by the following general formula (II):

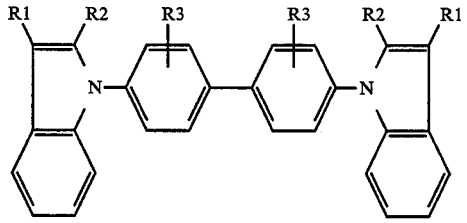

(I)

wherein, each of $R_1$ and $R_2$ is selected from the group consisting of a hydrogen atom, an alkyl group whose carbon number is 1–9, an aralkyl group and an aryl group and $R_3$ is selected from the group consisting of a hydrogen atom, an alkyl group whose carbon number is 1–3, an alkoxyl group and a halogen atom;

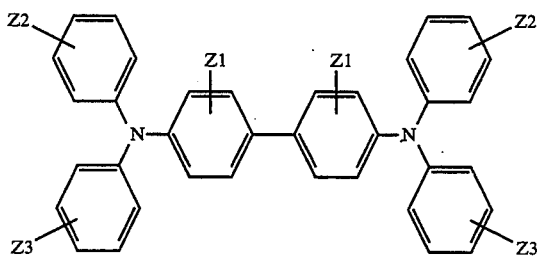

(II)

wherein, $Z_1$ is selected from the group consisting of a hydrogen atom or an alkyl group whose carbon number is 1–2, each of $Z_2$ and $Z_3$ is selected from the group consisting of a hydrogen atom, a alkyl group whose carbon number is 1–2 and a halogen atom.

Here, the photosensitive layer may comprise a single layer containing a mixture of the charge generating material and the charge transporting material.

The amount of the charge transporting material may be 20 to 60 weight % of the total amount of solid material of the photosensitive layer, and the ratio of the indole may compound to the benzidine compounds are in the rang from 5:95 to 95:5.

The amount of the charge generating material may be 10 to 50 weight % of the amount of the charge transporting material.

The photosensitive layer may comprise a laminate of a charge generating layer containing the charge generating material and a charge transporting layer containing the charge transporting material.

The amount of the charge transporting material may be 30 to 70 weight % of the total amount of the solid material of the charge transporting layer.

The amount of the charge generating material may be 33 to 77 weight % of the total amount of solid material of the charge generating layer.

The charge generating material may be a dis-azo pigment or a type X metal-free phthalocyanine.

A photoconductor for electrophotography may further comprise an undercoating layer providing between the conductive substrate and the photosensitive layer.

The photoconductor for electrophotography which is made of an organic photoconductive material, and has better stability of photoconductive characteristics, especially stability of the electric potential in continuous repeated use is obtained by using a mixture of the indole compound represented by the abovementioned general formula (I) and the benzidine compound represented by the above general formula (II) as the charge transporting substance than using the indole compound represented by the above general formula (I) singly or the benzidine compound represented by the above general formula (II) singly.

The advantageous features mentioned above, which is obtained by using a mixture of the both compounds, can be obtained independent of the structure of the photosensitive layer.

The advantageous features mentioned above can be obtained even if an intermediate layer is providing between the conductive substrate and the photosensitive layer. Therefore, the undercoating layer can be provided between the conductive substrate and the photosensitive layer in order to improve features such as a film forming capacity, adhesion between the conductive substrate and the photosensitive layer and/or photoconductive characteristics.

The charge generating substance usable in the present invention includes a dis-azo pigment and a type X metal-free phthalocyanine, which are preferably used to obtain a highphotosensitive photoconductor.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Photoconductors according to the present invention contains at least one compound selected from indole compounds represented by the above-mentioned general formula (I) and at least one compound selected from benzidine compounds represented by the abovementioned general formula (II) as the charge transporting substance in the photosensitive layer. The photoconductors are classified into two types according to their structure of the photosensitive layer which are shown in FIGS. 1 and 2, respectively.

Figure 1:
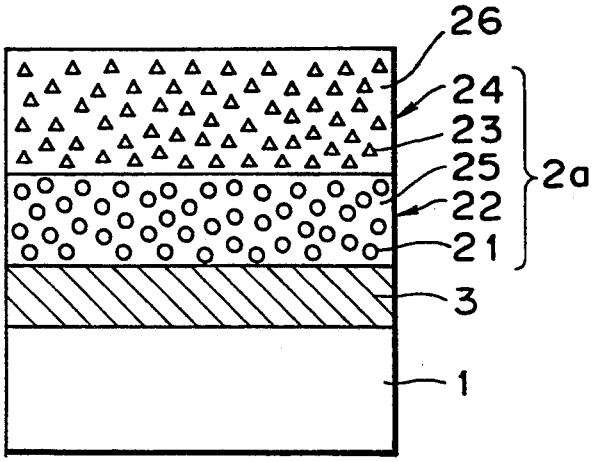
FIG. 1 is a schematic cross-sectional view showing an embodiment of a photoconductor according to the present invention.

FIG. 1 is a schematic cross-sectional view showing an embodiment of a laminate type photoconductor according to the present invention. A laminated photosensitive layer 2*a* is provided on an undercoating layer 3 coated on an electroconductive substrate 1, a lower layer of the laminate is a charge generating layer 22 comprising a charge generating substance 21 dispersed in a resin binder matrix 25 and an upper one is a charge transporting layer 24 comprising the indole compounds and the benzidine compounds as the charge transporting substance 23 both of which compounds are dispersed in a resin binder matrix 26, so that the photosensitive layer 2*a* functions as a laminate type photoconductor which has functionally distinguishable laminated two layers. This photoconductor is usually used in a negative charging mode.

Figure 2:
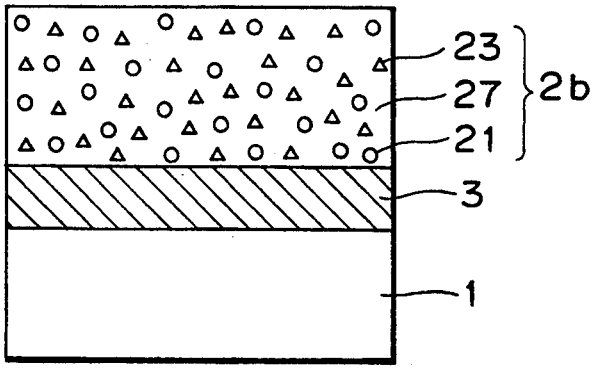
FIG. 2 is a schematic cross-sectional view showing another embodiment of a photoconductor according to the present invention.

FIG. 2 is a schematic cross-sectional view showing another embodiment of a monolayer photoconductor according to the present invention. A single photosensitive layer 2*b* is provided on an undercoating layer 3 coated on an electroconductive substrate 1. The photosensitive layer 2*b* comprises a charge generating substance 21 and the indole compounds and the benzidine compounds as the charge transporting substance 23 both of which substances are dispersed in a resin binder matrix 27, so that the photosensitive layer 2*b* functions as a monolayer type photoconductor.

It is to be understood that the undercoating layer 3 should be provided if necessary, not always be provided.

The electroconductive substrate 1 serves as an electrode of the photoconductor and as a support for a layer(s) formed thereon, and may be made of an electroconductive material such as aluminum, aluminum alloy or stainless steel, or other material having a surface treated to be electroconductive, such as glass so treated or a resin so treated.

The undercoating layer 3 provided between the electroconductive substrate and the photosensitive layer, if necessary, serves as a layer having functions of a barrier to carrier and raising adhesion. The undercoating layer may be a coated layer of casein, poly (vinyl alcohol), poly (vinyl methyl ether), poly-N-vinylimidazole, ethyl cellulose, ethylene-acrylic acid copolymer, a phenol resin, polyamide, polyurethane, gelatin, aluminum oxide and the like. The undercoating layer is generally formed with a thickness from 0.05 μm to 20 μm, preferably from 0.05 μm to 10 μm.

The charge generating layer 22 is formed by applying a dispersion, which is prepared by dispersing a particulate charge generating material 21 together with the resin binder of 0.2 to 2 times the amount of the charge generating material (the ratio of the amount of the particulate charge generating material is 33 to 77 weight % of the total amount of solid material of the charge generating layer) in a solvent, on the substrate, and drying. The dispersion can be prepared by means of a homogenizer, ultrasonic wave, a ball mill, a sand mill, a paint shaker or the like. The thickness of the charge generating layer is preferably 0.05 to 10 μm. Usable charge generating materials include phthalocyanine compounds such as metal-free pthalocyanine and titanyl phthalocyanine; various azo, quinone and indigo pigments; and dyes such as cyanine, squarylium, azulenium and pyrylium compounds. Among them, a suitable compound can be chosen depending on the wavelength range of a light source used for the image formation. Resin binders usable in the charge generating layer include poly (vinyl butyral) s, polyarylates, polycarbonates, polyesters, phenoxy resins, poly (vinylacetate)s, epoxy resins, acrylic resins, poly(acrylamide)s, polyamides, poly (vinyl pyridine) s, celluloses, urethane resins, caseins, poly(vinyl alcohol)s, poly(vinyl pyrrolidone)s, and the like. Solvents usable for dispersion include alcohols such as methanol, ethanol, isopropyl alcohol and the like; ketones such as acetone, methyl ethyl ketone, cyclohexanone and the like; amides such as N,N-dimethylformamide, N,N-dimethylacetamide and the like;

ethers such as tetrahydrofuran, dioxane, ethylene glycol dimethyl ether, dimethoxyethane, propylene oxide and the like; esters such as methyl acetate, ethyl acetate, dimethyl carbonate and the like; aliphatic hydrogen halides such as chloroform, dichloromethane, dichloroethylene, trichloroethylene and the like; and aromatic compounds such as benzene, toluene, xylene, monochlorobenzene and the like.

The charge transporting layer 24 is formed by coating a coating solution, in which the above mentioned indole compounds and benzidine compounds are dissolved in a solvent together with a suitable binder resin, on the charge generating layer, and drying the coating solution. The thickness of the charge transporting layer is 10 to 50 μm, preferably 15 to 40 μm. The total amount of the indole compounds and the benzidine compounds in the charge transporting substance is 30 to 70 weight %, especially 40 to 60 weight % of the total amount of solid substance of the charge transporting layer. The ratio of the indole compounds and benzidine compounds are in the range from 5:95 to 95:5, preferably 60:40 to 20:80. Resin binders usable in the charge transporting layer include acrylic resins, polyarylates, polyesters, polycarbonates, polystyrenes, acrylonitrile-styrene copolymers, poly(vinyl butyral)s, poly(vinyl formal)s, polyacrylamides, polyamides, and the like. Solvents usable for the coating solution are the same as ones for forming the charge generating layer.

The single photosensitive layer **2*b* is formed by coating the coating solution on the substrate and drying. A coating solution for the single photosensitive layer 2*b* is prepared by dissolving or dispersing the charge generating material 21 and the charge transporting material 23** comprising the mixture of indole compounds and benzidine compounds of 2 to 10 times the amount of the charge generating material in a solvent together with a suitable binder resin. The thickness of the single photosensitive layer is 10 to 40 μm, preferably 15 to 25 μm. The total of the indole compounds and the benzidine compounds is 20 to 60 weight %, especially 30 to 50 weight % of the total amount of solid substance of the single photosensitive layer. The ratio of the indole compounds to the benzidine is same as in the charge transporting layer. Resin binders usable in the single photosensitive layer include polycarbonates, polyarylates, polystyrenes, epoxy resins, urethane resins, melamine resins, and the like. Solvents usable for the coating solution are the same as ones for forming the charge generating layer.

Specific examples of the indole compound of the general formula (I) include the compounds listed below.

Compound No. 1

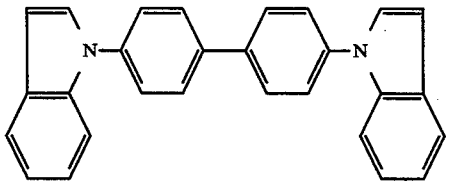

-continued

Compound No. 2

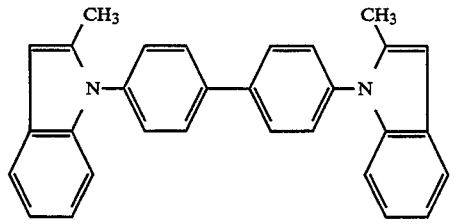

Compound No. 3

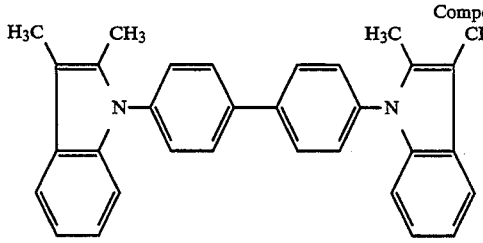

Compound No. 4

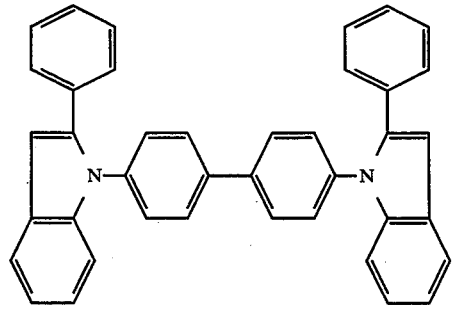

Compound No. 5

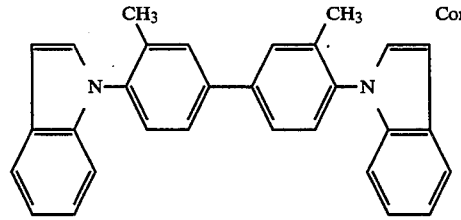

Compound No. 6

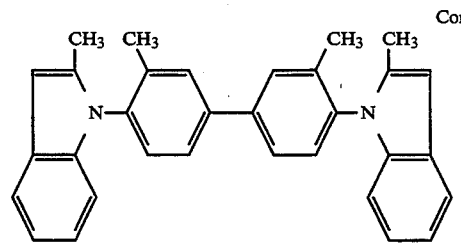

Compound No. 7

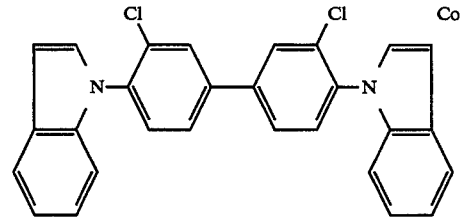

-continued

Compound No. 8

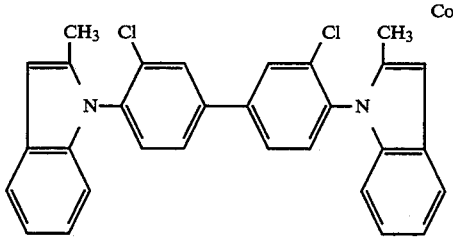

Compound No. 9

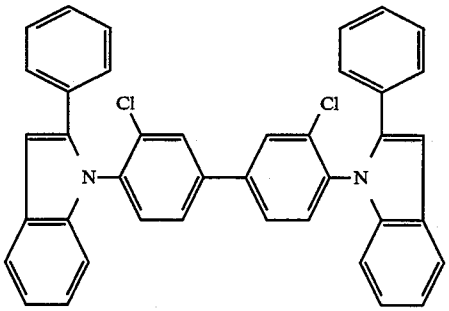

Compound No. 10

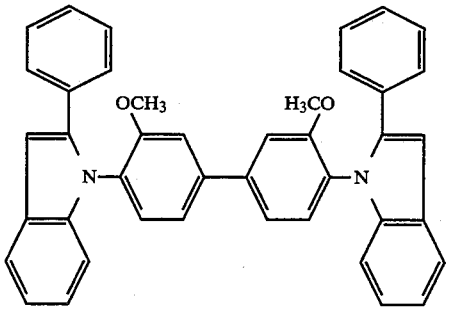

Specific examples of the benzidine compound of the general formula (II) includes the compounds listed below.

Compound No. 11

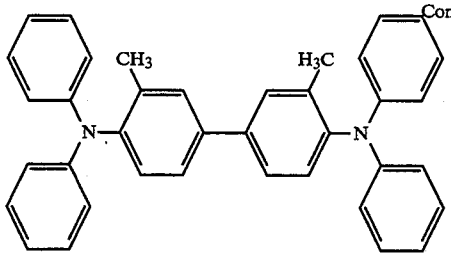

Compound No. 12

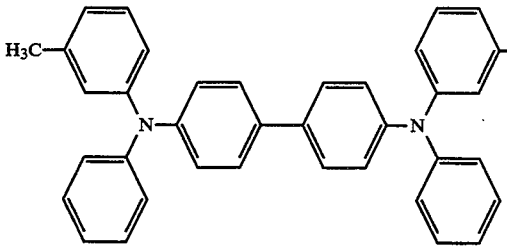

-continued

Compound No. 13

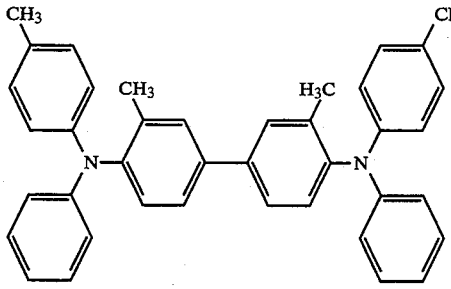

Compound No. 14

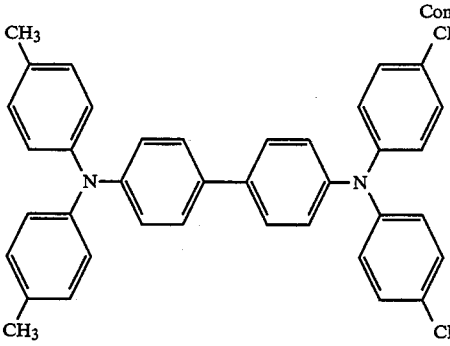

Compound No. 15

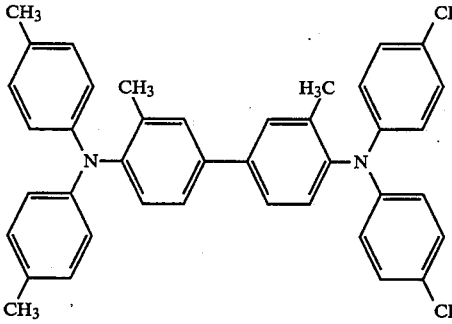

Preparation Example of the compound No. 1

8.12 g (0.02 mol) of diiodobiphenyl, 4.68 g (0.04 mol) of indole, 8.29 g (0.06 mol) of potassium carbonate, 1.2 g of powder copper and 50 ml of sulforane are fed to the tree neck flask with a Dimroth condenser, and the atmosphere was replaced with the nitrogen. After then, they were heated and mixed at a temperature of 250° C. for 24 hours. The reactant mixtures were washed twice with hot water and hot methanol, respectively. The residue was dissolved with methylene chloride, and dried with sodium sulfate anhydride. Methylene chloride was removed from the solution to obtain an oily substance. The oily substance was dissolved with n-hexane-ether (3/1). Upon recrystallization from the n-hexane-ether solution 4.2 g (in the 54% yield) of the indole compound No. 1 mentioned above was given as white powder. The compound No. 1 was identified by elemental analysis.

| Elemental analysis values | | | |
|---|---|---|---|
| Calculated values | 87.5 | 5.2 | 7.3 |
| Found values | 87.6 | 5.4 | 7.1 |

The other indole compounds mentioned above can be prepared in the same manner as in Preparation example of the compound 1 except that using indole derivatives and diiodobiphenyl derivatives correspond to the compounds.

The process for preparing benzidine compounds mentioned above were disclosed in U.S. Pat. No. 3,314,788 and Japanese Patent Application Publication No. 58-52,983.

Examples will now be given. However, it is to be understood that the invention is not intended to be limited to these examples.

EXAMPLE 1

An aluminum plate having a length of 30 mm, a width of 30 mm and a thickness of 1 mm was provided as the electroconductive substrate. 4.5 parts of a polyamide resin (manufactured by Toray Industries: AMIRAN CM8000) was dissolved in 150 parts by weight of methanol to prepare a coating solution. The coating solution was coated on the plate by means of a dipping, and dried at a temperature of 90° C. for 20 minutes to form an undercoating layer having a dry thickness of 0.2 μm.

2 parts by weight of dis-azo pigment represented by the structural formula (A) mentioned below and 2 parts by weight of polyester resin (Vylon 200 (trademark), manufactured by Toyobo Co., Ltd.) as the binder resin were mixed with 90 parts by weight of cyclohexanone, and dispersed by means of a sand grinder for 6 hours to prepare a dispersion solution. This dispersion solution was diluted by adding 60 parts by weight of tetrahydrofuran to prepare a coating solution. This coating solution was applied by means of a dipping on the undercoating layer, and dried at a temperature of 90° C. for 20 minutes to form an charge generating layer having a dry thickness of 0.4 μm.

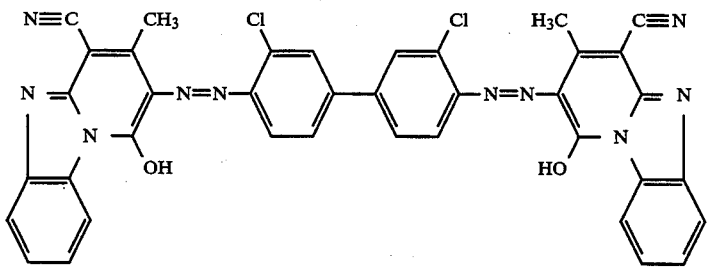

Structural formula (A)

1.5 parts by weight of the indole compound No. 5 mentioned above and 1.5 parts by weight of the benzidine compound No. 12 as the charge transporting material are dissolved in 30 parts by weight of tetrahydrofuran together with 3 parts by weight of bisphenol Z polycarbonate (the number average molecular weight is 50,000) to prepare a coating solution. This coating solution was applied on the charge generating layer by means of the wire bar technique, and dried to form a charge transporting layer having a dry thickness of 15 μm. Thus, a laminate type photoconductor with the structure shown in FIG. 1 was produced.

EXAMPLE 2

The photoconductor of Example 2 was produced in substantially the same manner as in Example 1 except that 2.1 parts by weight of the indole compound No. 5 and 0.9 parts by weight benzidine compound No. 12 were used as the charge transporting material.

EXAMPLE 3

The photoconductor of Example 3 was produced in substantially the same manner as in Example 1 except that 0.3 parts by weight of the indole compound No. 5 and 2.7 parts by weight benzidine compound No. 12 were used as the charge transporting material.

EXAMPLE 4

The photoconductor of Example 4 was produced in substantially the same manner as in Example 1 except that the indole compound No. 8 and the benzidine compound No. 14 were used as the charge transporting material instead of the compound No. 5 and the compound No. 12, respectively.

Comparative Example 1

The photoconductor of Comparative Example 1 was produced in substantially the same manner as in Example 1 except that 3 parts by weight of the indole compound No. 5 alone was used as the charge transporting material instead of 1.5 parts by weight of the indole compound No. 5 and 1.5 parts by weight of the benzidine compound No. 12.

Comparative Example 2

The photoconductor of Comparative Example 2 was produced in substantially the same manner as in Example 1 except that 3 parts by weight of the indole compound No. 8 alone was used as the charge transporting material instead of 1.5 parts by weight of the indole compound No. 5 and 1.5 parts by weight of the benzidine compound No. 12.

Comparative Example 3

The photoconductor of Comparative Example 3 was produced in substantially the same manner as in Example 1 except that 3 parts by weight of the benzidine compound No. 12 alone was used as the charge transporting material instead of 1.5 parts by weight of the indole compound No. 5 and 1.5 parts by weight of the benzidine compound No. 12.

The photoconductors thus produced were examined with respect to electrophotographic characteristics. Furthermore, the variation of the charged electric potential and the residual electric potential were measured when each photoconductor was charged, irradiated and discharged repeatedly, as the characteristics in the repeated use thereof. These are measured by utilizing an electrostatic charge testing apparatus (Kawaguchi Denki Seisakusho Model SP-428). The electrophotographic characteristics were evaluated according to the half decay exposure amount $E_{\frac{1}{2}}$ which was measured in the manner that the surface of the photoconductor was charged in the dark by corona discharge at −6.0 kV for 10 seconds, and irradiated with white light at an illuminance of 2 luxes, then the exposure amount required for the irradiation to decrease the surface potential of the photoconductor by one half of the initial surface potential was calculated. Also, the surface potential of the photoconductor after 10 seconds of irradiation thereof using a monochromatic light with a wavelength of 780 nm and power of 1 μW was measured as a residual potential. Thereafter, the charged potential and the residual potential are measured before and after the repeated process of 5000 cycles of charging, irradiating and discharging. The results of the measurements are shown in Table 1.

TABLE 1

| | HALF DELAY EXPOSURE AMOUNT $E_{\frac{1}{2}}$ (lx · sec) | THE CHARACTERISTICS IN THE REPEATED USE | | | |
|---|---|---|---|---|---|
| | | CHARGED ELECTRIC POTENTIAL (V) | | RESIDUAL ELECTRIC POTENTIAL (V) | |
| | | INITIAL | AFTER 5000 CYCLES | INITIAL | AFTER 5000 CYCLES |
| Example 1 | 3.7 | −683 | −675 | −42 | −48 |
| Example 2 | 3.7 | −691 | −685 | −49 | −55 |
| Example 3 | 3.6 | −672 | −653 | −40 | −45 |
| Example 4 | 3.8 | −680 | −677 | −48 | −54 |
| Comparative Example 1 | 3.7 | −678 | −664 | −42 | −82 |
| Comparative Example 2 | 3.5 | −680 | −673 | −46 | −73 |
| Comparative Example 3 | 3.4 | −632 | −511 | −39 | −44 |

As can be seen in Table 1, the photoconductors of Comparative Examples 1 and 2 using only an indole compound showed a large variation of the residual potential, in comparative to the photoconductors of Examples 1 to 4 using an indole compound and a benzidine compound as a charging transporting material in a charging transporting layer, and the photoconductor of Comparative Example 3 using only a benzidine compound showed a large variation of the charged potential. Accordingly, it is clear that the advantageous features can be obtained by using the above mentioned both substances as the charge transporting material in the laminate type photoconductor.

EXAMPLE 5

An aluminum plate having a length of 30 mm, a width of 30 mm and a thickness of 1 mm was provided as the electroconductive substrate in the same manner as in Example 1. 4.5 parts by weight of a polyamide resin (manufactured by Daiseru Co., Ltd.: DAIAMIDE T-171) was dissolved in 150 parts by weight of methanol to prepare a coating solution. The coating solution was coated on the plate by means of a dipping, and dried at a temperature of 90° C. for 20 minutes to form an undercoating layer having a dry thickness of 0.2 μm.

1.5 parts by weight of the indole compound No. 2 mentioned above and 1.5 parts by weight of the benzidine compound No. 13 as the charge transporting material were dissolved in 60 parts by weight of dichrolomethane together with 2.5 parts by weight of bisphenol Z polycarbonate (whose the number average molecular weight is 50,000) and 1 parts by weight of poly (vinylbutyral) (ESLEX BX-2, manufactured by Sekisui Chemical Co., Ltd.), and further 0.5 parts by weight of the type X metal-free phthalocyanine was dispersed in the resultant solution by means of the ball mill to prepare a dispersion solution. This dispersion solution was applied on the charge generating layer by means of the wire bar technique, and dried at a temperature of 100° C. for 20 minutes to form a photosensitive layer having a dry thickness of 20 μm. Thus, a monolayer type photoconductor with the structure shown in FIG. 2 was produced.

EXAMPLE 6

The photoconductor of Example 6 was produced in substantially the same manner as in Example 5 except that 2.1 parts by weight of the indole compound No. 5 and 0.9 parts by weight benzidine compound No. 13 were used as the charge transporting material.

EXAMPLE 7

The photoconductor of Example 7 was produced in substantially the same manner as in Example 5 except that 0.3 parts by weight of the indole compound No. 2 and 2.7 parts by weight benzidine compound No. 13 were used as the charge transporting material.

EXAMPLE 8

The photoconductor of Example 8 was produced in substantially the same manner as in Example 5 except that the indole compound No. 9 and the benzidine compound No. 15 were used as the charge transporting material instead of the compound No. 2 and the compound No. 13, respectively.

Comparative Example 4

The photoconductor of Comparative Example 4 was produced in substantially the same manner as in Example 5 except that 3 parts by weight of the indole compound No. 2 alone was used as the charge transporting material instead of 1.5 parts by weight of the indole compound No. 2 and 1.5 parts by weight of the benzidine compound No. 13.

Comparative Example 5

The photoconductor of Comparative Example 5 was produced in substantially the same manner as in Example 5 except that 3 parts by weight of the indole compound No. 9 alone was used as the charge transporting material instead of 1.5 parts by weight of the indole compound No. 2 and 1.5 parts by weight of the benzidine compound No. 13.

Comparative Example 6

The photoconductor of Comparative Example 6 was produced in substantially the same manner as in Example 5 except that 3 parts by weight of the benzidine compound No. 13 alone was used as the charge transporting material instead of 1.5 parts by weight of the indole compound No. 2 and 1.5 parts by weight of the benzidine compound No. 13.

The photoconductors thus produced were examined with respect to electrophotographic characteristics. Furthermore, the variation of the charged electric potential and the residual electric potential, which were measured when each photoconductor was charged, irradiated and discharged repeatedly, as the characteristics in the repeated use thereof. These are measured by utilizing an electrostatic charge testing apparatus (Kawaguchi Denki Seisakusho Model SP-428) in the same manner as in Example 1. The electrophotographic characteristics were evaluated according to the half decay exposure amount $E_{\frac{1}{2}}$ which was measured in the manner that the surface of the photoconductor was charged in the dark by corona discharge at +6.0 kV for 10 seconds, and irradiated with white light at an illuminance of 2 luxes, then the exposure amount required for the irradiation to decrease the surface potential of the photoconductor by one half of the initial surface potential was calculated. Also, the surface potential of the photoconductor after 10 seconds of irradiation thereof using a monochromatic light with a wavelength of 780 nm and power of 1 $\mu$W was measured as a residual potential. Thereafter, the charged potential and the residual potential are measured before and after the repeated process of 5000 cycles of charging, irradiating and discharging. The results of the measurements are shown in Table 2.

TABLE 2

| | HALF DELAY EXPOSURE AMOUNT $E_{\frac{1}{2}}$ (1x · sec) | THE CHARACTERISTICS IN THE REPEATED USE | | | |
|---|---|---|---|---|---|
| | | CHARGED ELECTRIC POTENTIAL (V) | | RESIDUAL ELECTRIC POTENTIAL (V) | |
| | | INITIAL | AFTER 5000 CYCLES | INITIAL | AFTER 5000 CYCLES |
| Example 5 | 4.8 | 679 | 667 | 48 | 54 |
| Example 6 | 5.2 | 693 | 681 | 48 | 59 |
| Example 7 | 4.6 | 665 | 648 | 45 | 51 |
| Example 8 | 5.0 | 668 | 652 | 51 | 58 |
| Comparative Example 4 | 4.5 | 664 | 645 | 49 | 69 |
| Comparative Example 5 | 5.0 | 671 | 643 | 50 | 73 |
| Comparative Example 6 | 4.9 | 644 | 559 | 44 | 46 |

As can be seen in Table 2, the photoconductors of Comparative Examples 4 and 5 using only an indole compound showed a large variation of the residual potential, in comparative to the photoconductors of Examples 5 to 8 using an indole compound and a benzidine compound as a charging transporting material in a charging transporting layer, and the photoconductor of Comparative Example 6 using only a benzidine compound showed a large variation of the charged potential. Accordingly, it is clear that the advantageous features can be obtained by using the above mentioned both substances as the charge transporting material in the laminate type photoconductor.

The photoconductor for electrophotography according to the present invention has a photosensitive layer containing at least one compound selected from the indole compounds represented by the above-mentioned general formula (I) and at least one compound selected from the benzidine compounds represented by the above general formula (II) as the charge transporting material. The photoconductor for electrophotography having better stability-of photoconductive characteristics, especially having stability of the potential in continuous repeated use is obtained by using a mixture of the indole compound and the benzidine compound as the charge transporting material.

The advantageous features mentioned above can be obtained independent of the structure of the photosensitive layer, which may comprise monolayer or the laminate, and even if an intermediate layer is providing between the conductive substrate and the photosensitive layer.

The present invention has been described in detail with respect to preferred embodiments, and it will now be that changes and modifications may be made without departing from the invention in its broader aspects, and it is the intention, therefore, in the appended claim to cover all such changes and modifications as fall within the true spirit of the invention.

What is claimed is:

1. A photoconductor for electrophotography comprising:

a conductive substrate; and a photosensitive layer formed on said conductive substrate and including a charge generating material and a charge transporting material:

wherein the said charge transporting material comprises at least one compound selected from indole compounds represented by following general formula (I) and at least one compound selected from benzidine compounds represented by the following general formula (II):

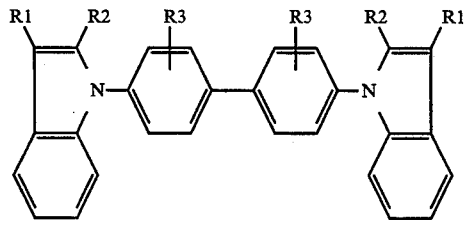

(I)

wherein, each of $R_1$ and $R_2$ is selected from the group consisting of a hydrogen atom, an alkyl group whose carbon number is 1–9, an aralkyl group and an aryl group and $R_3$ is selected from the group consisting of a hydrogen atom, an alkyl group whose carbon number is 1–3, an alkoxyl group and a halogen atom;

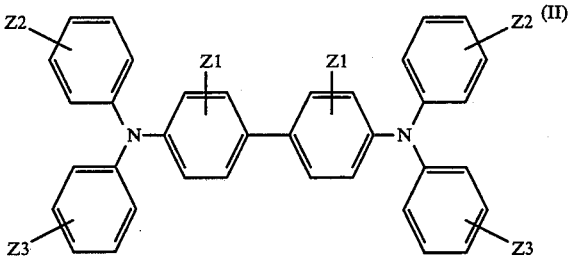

wherein, $Z_1$ is selected from the group consisting of a hydrogen atom or an alkyl group whose carbon number is 1–2, each of $Z_2$ and $Z_3$ is selected from the group consisting of a hydrogen atom, a alkyl group whose carbon number is 1–2 and a halogen atom.

2. A photoconductor for electrophotography as claimed in claim 1, wherein of said photosensitive layer comprises a single layer containing a mixture of the charge generating material and the charge transporting material.

3. A photoconductor for electrophotography as claimed in claim 2, wherein the amount of said charge transporting material is 20 to 60 weight % of the total amount of solid material of said photosensitive layer, and the ratio of said indole compounds to said benzidine compounds are in the rang from 5:95 to 95:5.

4. A photoconductor for electrophotography as claimed in claim 3, wherein the amount of said charge generating material is 10 to 50 weight % of the amount of said charge transporting material.

5. A photoconductor for electrophotography as claimed in claim 1, wherein said photosensitive layer comprises a laminate of a charge generating layer containing said charge generating material and a charge transporting layer containing said charge transporting material.

6. A photoconductor for electrophotography as claimed in claim 5, wherein the amount of said charge transporting material is 30 to 70 weight % of the total amount of the solid material of said charge transporting layer.

7. A photoconductor for electrophotography as claimed in claim 6, wherein the amount of said charge generating material is 33 to 77 weight % of the total amount of solid material of said charge generating layer.

8. A photoconductor for electrophotography as claimed in claim 1, wherein said charge generating material is a dis-azo pigment or a type X metal-free phthalocyanine.

9. A photoconductor for electrophotography as claimed in claim 1, further comprises an undercoating layer providing between said conductive substrate and said photosensitive layer.

* * * * *